US006189912B1

(12) United States Patent
Ritzinger

(10) Patent No.: US 6,189,912 B1
(45) **Date of Patent: *Feb. 20, 2001**

(54) SLIDE BOARD

(75) Inventor: Oliver Ritzinger, Munich (DE)

(73) Assignee: Boards Unlimited Sportarikel GmbH & Co. KG, Gunding (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/904,980

(22) Filed: Aug. 1, 1997

(30) Foreign Application Priority Data

Mar. 25, 1997 (DE) ..... 197 12 569

(51) Int. Cl.[7] ..... A63C 5/04

(52) U.S. Cl. ..... 280/609; 280/604; 280/14.2; 280/18; 280/28.11

(58) Field of Search ..... 280/14.2, 15, 18, 280/23.14, 28.11, 28.16, 87.042, 607, 608, 609, 604; 441/68, 74

(56) References Cited

U.S. PATENT DOCUMENTS

| | | | | |
|---|---|---|---|---|
| 3,412,183 | | 11/1968 | Anderson et al. . | |
| 3,580,598 | * | 5/1971 | De Pauw | 280/18 |
| 3,628,804 | * | 12/1971 | Carriero | 280/18 |
| 3,861,698 | | 1/1975 | Greig . | |
| 3,884,490 | * | 5/1975 | Hellman | 280/18 |
| 4,108,452 | * | 8/1978 | Baron | 280/87.042 |
| 4,533,150 | * | 8/1985 | Hardy | 280/14.2 |
| 4,561,664 | * | 12/1985 | Cashmere | 280/18 |
| 4,666,171 | * | 5/1987 | Sellers | 280/18 |
| 4,857,025 | * | 8/1989 | Brown et al. | 441/74 |
| 4,928,983 | * | 5/1990 | Maass | 280/18 |
| 5,266,249 | * | 11/1993 | Grimes, III et al. | 441/74 |
| 5,308,271 | * | 5/1994 | Foulke | 441/74 |
| 5,566,959 | * | 10/1996 | Tiramani | 280/28.14 |
| 5,687,983 | * | 11/1997 | Feketa et al. | 280/609 |
| 5,807,152 | * | 9/1998 | Wojcik | 441/74 |
| 5,816,589 | * | 10/1998 | Southworth | 280/14.2 |
| 5,924,718 | * | 7/1999 | Gordon et al. | 280/14.2 |
| 5,957,471 | * | 9/1999 | Weeks | 280/18 |

FOREIGN PATENT DOCUMENTS

| | | | | |
|---|---|---|---|---|
| 2711930A1 | | 9/1978 | (DE) . | |
| 2749027A1 | | 5/1979 | (DE) . | |
| 2801859A1 | | 7/1979 | (DE) . | |
| 2924023A1 | | 12/1980 | (DE) . | |
| 3421997A1 | | 12/1985 | (DE) . | |
| 36 07808 | | 9/1987 | (DE) . | |
| 8705677 U | | 9/1989 | (DE) . | |
| 41 24519 | | 1/1993 | (DE) . | |
| 94 01326 U | | 9/1994 | (DE) . | |
| 747099 | | 4/1994 | (EP) . | |
| 1586731 | * | 8/1990 | (SU) | 280/14.2 |
| WO 93/19824 | | 10/1993 | (WO) . | |
| WO 95/29743 | | 11/1995 | (WO) . | |
| WO96/24411A1 | | 8/1996 | (WO) . | |

* cited by examiner

*Primary Examiner*—Frank Vanaman
(74) *Attorney, Agent, or Firm*—Rockey, Milnamow & Katz, Ltd.

(57) ABSTRACT

A new slide or snow board is described having a structure of the bottom side or slide face of a central slide structure and lateral guide surfaces, which enables a simple and substantially drift-free steering mechanism. Therefore, this slide board is in particular suitable for beginners, children or unathletic users.

11 Claims, 2 Drawing Sheets

SLIDE BOARD

BACKGROUND OF THE INVENTION

1. Field of the Invention

The present invention refers to a slide board, i.e. an article of sports equipment, on which a user of a board can slide down a slope. Slide boards of this kind are generally known as snow boards, the fields of application thereof are, however, not restricted to snow or artificial snow, but these boards may also be used on slopes prepared otherwise.

2. Description of the Related Art

The slide boards or snow boards are known in the form of substantially flat boards constricted in the longitudinal direction and leading and trailing ends. A slide face pointing downwardly is formed in a flat and unstructured manner. The slide board is somewhat flexible and is steered in view of its constricted shape when the board is bent by putting the load on one side.

Slide boards of this kind require relatively sophisticated driving skills from the user of the board and are hardly suitable for being used by children or unathletic people.

This is aggravated by the steering mechanism, which, when driving through a curve, leads to a drift motion, i.e. to a weight component that is transverse with respect to the elongation of the board. Accordingly, greater transverse forces occur. Therefore, these known slide boards all have foot loops or holding devices similar to ski bindings for special shoes. In this way the user of the board is somehow "tied" to the board. Thus, he cannot easily change the position of his feet on the slide board or put down a foot to support himself on the ground during standstill of the board or slow slide. In order not to fall down when sliding or during a standstill, certain experience with the slide board and a good sense of balance is required.

The object of the invention is to provide a slide board that has properties enabling the use of the slide board by children or inexperienced or unathletic people.

This object is achieved according to the invention by a slide board having a top side step surface board and a lower side slide face with a centrally and downwardly projecting, elongated guide structure extending in the driving direction, and, seen in the driving direction, at least one downwardly projecting guide structure on both sides of the slide structure elongated in the driving direction, and convex with respect to the slide structure and extending downwards to a lesser extent than said slide structure.

BRIEF SUMMARY OF THE INVENTION

The object of the centrally projecting slide structure of this slide board is a substantially brakeless straight sliding and thus the ability to also be used on flat slopes for beginners. Therefore, the slide structure has to be designed such that the slide board can be substantially supported by the slide structure alone, at least on a somewhat harder ground when sliding straight down the slope and when the load is put on the center The shape of the slide structure shall be adapted to the lowest possible slide resistance.

The slide structure is preferably a ski-like structure, which in a preferred embodiment at least comprises a concave, longitudinally extending recess and straightly rimmed slide faces beside the recess(es).

In view of the slide properties and the required support surface, a slide structure is advantageous that is not too broad but continuous over the entire length of the slide board.

In contrast thereto, the lateral guide structures have the function of causing a curved sliding of the slide board in case of a lateral load and a corresponding tilt of the slide board. For this purpose, they are provided according to the invention, in a manner not projecting as far as the slide structure and bent convexely with respect to the slide structure. Supposing the slide board was put on a solid ground, the steering movement corresponds to a tilt of the slide board about its longitudinal axis, a subsequent contact between the guide structure and the ground and a curved slide by the influence of the slide properties by the bent form of the guide structure. On non-rigid ground, this tilt movement rather corresponds to a change of the relative force introduction into the slide structure and the guide structures.

Since the guide structures in this respect have possibly good guide properties, or so to speak "grip", and the support or slide properties shall not appear during a straight run down the slope, the guide structures are designed in a simple and advantageous manner with a simple, narrow cross-sectional profile, i.e. as so-called rail projections.

Although a plurality of guide structures could basically be provided on each side of the slide structure, in favour of the straight slide properties, the slide face of the slide board should, however, on the whole not be structured too strongly. A favorable compromise of straight slide properties and a defined steering behavior is established by providing one guide structure only on each side of the slide board. The slide properties may be influenced by the profile and the curvature of the guide structures, but most of all by the extent to which the slide structure projects downwardly to a greater extent than the guide structures. The smaller this difference is, the stronger the straight slide will be braked and the more definite the slide board will react on the shifting of weight by a curved drive. On the other hand, a greater difference puts higher demands on the sense of balance of the user of the board. Of course, these delicacies of the design of the entire slide face of the slide board also have to be seen in connection with the driving ground that is taken into consideration each time.

The guide structures can also be evenly integrated with an outer edge of the slide board in particular in the cited rail design, so that the lateral finish of one guide structure each is identical to the outer edge. This not only leads to an elegant, uniform appearance caused by the inevitably constricted shape of the slide board, but also leads to an especially good grip during curved sliding caused by the thickness of the slide board additionally appearing as the height of the guide structure. Additionally, such a simplified shape of the slide board also offers advantages in manufacture.

A braking means of the slide board is not compulsory but rather sensible. For this purpose, a braking projection is provided at the trailing end of the slide board, which for optimizing the braking effect, has a strong profile and which projects transversely to the driving direction, i.e. transversely to the slide structure. The board brakes by putting one's load on the rear of the slide board during the slide. The braking projection projects less far down than the slide structure, so that it influences the straight slide as little as possible. At best it would be attached in an upwardly bent portion of the trailing end of the slide board, so that it contacts the ground only in case of a strong tilt movement of the slide board about its lateral axis.

As becomes evident from the above explanations regarding the shape of the slide face, a curved rive line of the slide board according to the invention corresponds to a curved line, the curvature of which being between the (stronger) curvature of the guide structure inducing the curved slide and the straight design of the central slide structure. It depends on the asymmetry of the load of the slide board by the user how far the curved slide line tends more to the one or to the other of these two limits.

It is typical for the slide board according to the invention that no or just a small drift component occurs, i.e. that the lateral forces during a curved slide are relatively low in this type of slide board. Thereby, the slide board according to the invention can be handled much more easily and a slip-free step face on the slide board is achieved which is sufficient and foot loops do not have to be provided. Thus, the freedom of the user of the board is much greater and the difficulties, in particular for a beginner when learning, are severely reduced.

In this connection, the flexibility and versatility of the use is also increased. One may sit or lie on the slide board or it may be used like a children's sledge. Accordingly, the manufacture is also facilitated, since a slip-free step face can be easily manufactured from an appropriate profile and a suitable selection of the slide board material or from an attached slip-free step pad.

An embodiment of the slide board that is simple to manufacture and very simple to handle is a blown plastic hollow body, preferably having inner bracing webs or bracing points for a sufficiently stable hollow chamber structure. Thereby, the additional material, the additional working step and the additional weight of a foam material become superfluous.

A suitable material for the slide board according to the invention in this connection and in a general connection is polyethylene.

A concrete embodiment of the above generally described invention is now described by means of FIGS. 1 to 5.

DETAILED DESCRIPTION OF THE INVENTION

Figure 1:
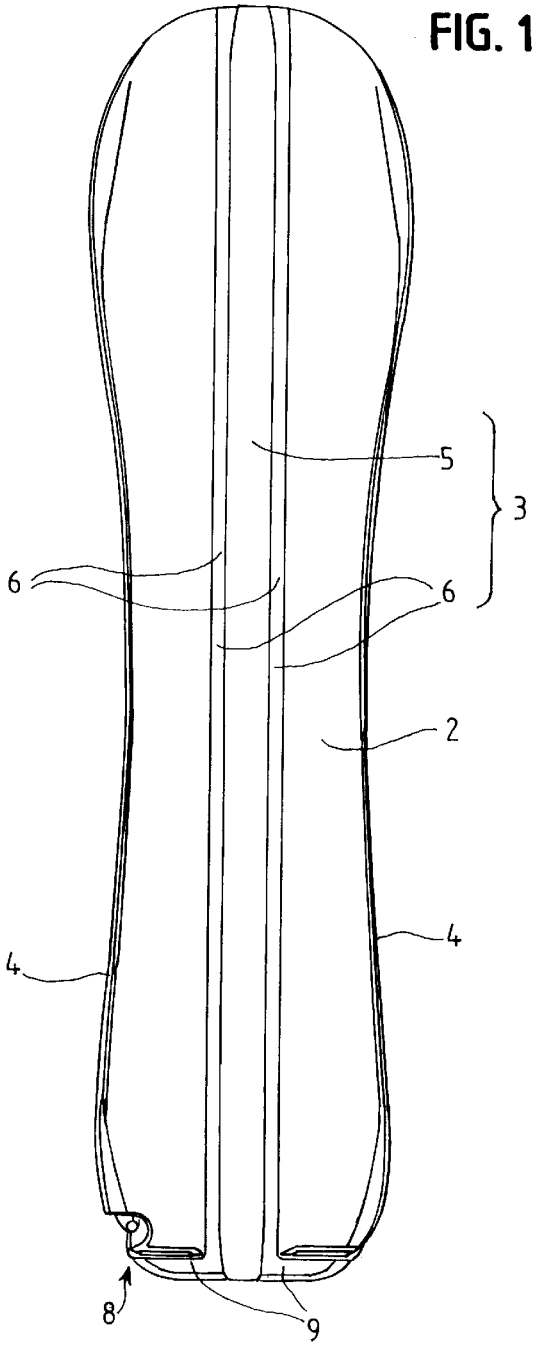
FIG. 1 is a bottom view.

FIG. 1 shows in a bottom view a slide board according to the invention, wherein the front end, i.e. the bow of the slide board is on top and the rear end, i.e. the back 8 is on the bottom. Two parallel strips extend from the front to the back 8 in the center of the slide board, said strips representing the slide faces 6 of a centrally projecting slide structure 3. The slide structure 3 further comprises a concave recess 5 between the two slide faces 6.

Figure 2:
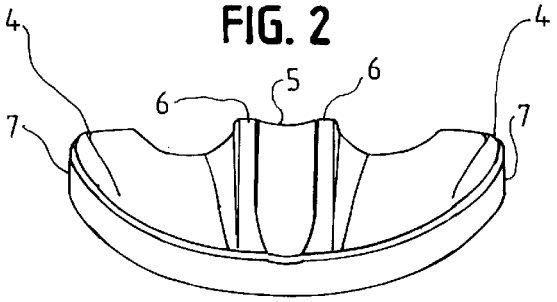
FIG. 2 is a front view with a bottom side pointing upwardly.

This becomes clear from the front view in FIG. 2, in which it can be seen that the recess 5 is relatively flat, i.e. considerably less deep than the height by which the slide structure 3 is offset with respect to the parts of the slide face 2 located at the side thereof, i.e. the bottom side of the slide board.

On the whole, the slide structure 3 forms a kind of a ski having slide faces with straight side edges, said ski extending over the entire length of the slide board.

FIGS. 1 and 2 further show that narrow rail projections 4 are provided as guide structures on both sides of this ski-like slide structure 3 behind the offset portion of the slide face 2 and at the lateral rim of the slide board. These guide structures project less far, as can be seen in FIG. 2, with respect to the offset portion of the slide face 2 than the central slide structure 3 and are furthermore, as can be seen in FIG. 1, bent convexely over the largest part of the length of the slide board with respect to the central slide structure.

This convex curvature coincides with the outer contour of the slide board, i.e. with the lateral outer edges 7 (FIG. 2), with which the guide structures 4 are integrated, i.e. provided continuously seen from the side. Accordingly, the slide board has a lateral constriction corresponding to the shape of the guide structures 4.

Figure 3:
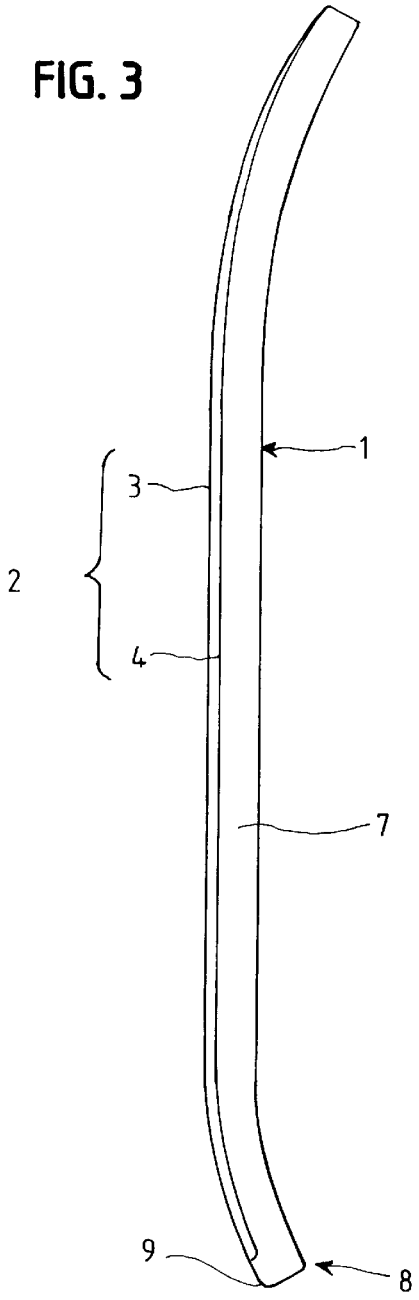
FIG. 3 is a side view of the slide board according to the invention with a bottom side pointing to the left.

FIG. 3 shows a side view of the slide board in which the two lines at the left edge of the slide board represent the difference in the projection of the slide structure 3 and the guide structures 4. The expression slide face designates the bottom lower side in total of the slide board, comprising the slide structure 3, the guide structures 4 and the intermediate regions. It can be seen from both FIGS. 2 and 3 that the leading end and the trailing end 8 of the slide board are bent upwardly. The bending of the leading end basically has the function to prevent diving into the soft ground, e.g. deep snow. The bent-up portions of the trailing end 8 enable the attachment of the braking projection 9, shown in FIG. 1, extending transversely to the ski-like slide structure 3 and which finishes this slide structure evenly with the back. The braking projection 9 does not contact or only slightly contacts the ground during normal sliding. The projection is used when the user of the board puts so much load on the bent-up trailing end 8 that the board tilting about its transverse axis contacts the ground by its bent-up trailing end 8. Moreover, the bent-up portions at the leading end and at the trailing end 8 are important for certain sliding manoeuvers, ire. if either the leading or the trailing end are loaded on one side and used like a pivot point for a turn of the slide board on the spot.

Figure 4:
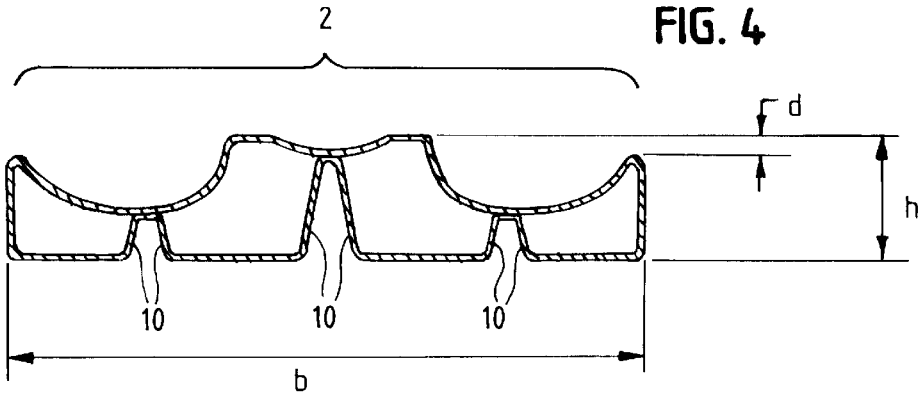
FIG. 4 is a schematic sketch of a cross-section through the slide board seen in the longitudinal direction to illustrate the inner structure.

FIG. 4 shows a schematic view, which regarding its perspective, corresponds to FIG. 2, but shows a cross-section through the slide board. Besides the already discussed details, bracing webs 10 can be seen, which are continuously formed by respective grooves in the step face 1 of the slide board each in pairs between the step face and the slide face 2. A contact or fusion of the groove or the bracing webs with the slide face 2 results at the area of each groove closest to the slide face due to the material thickness.

Figure 5:
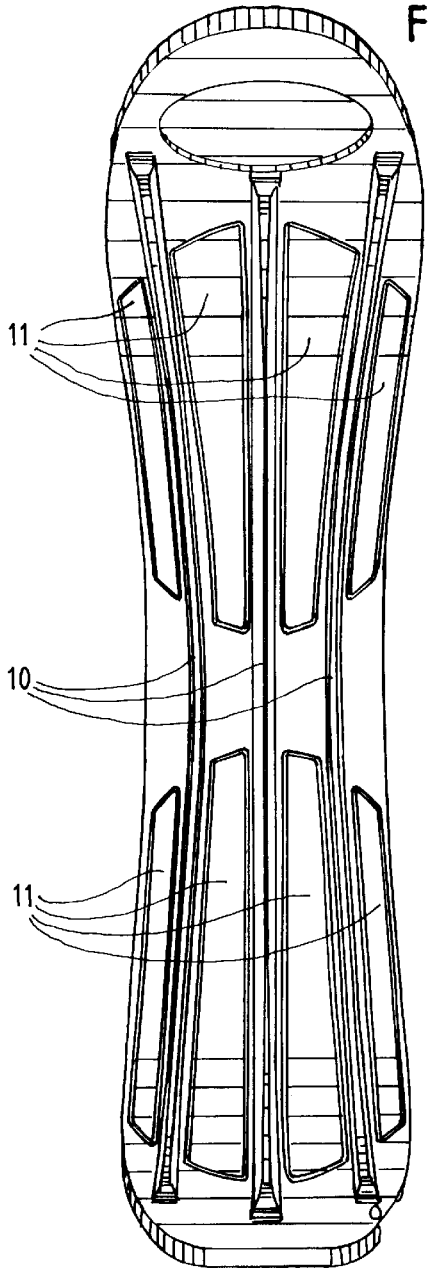
FIG. 5 is a top view of the slide board, wherein additionally lines of height are drawn in at the front and at the back.

These grooves are further shown in FIG. 5, since they are obvious and can be seen from the side of the step face 1, i.e. the upper side of the slide board. This is a result of the manufacture of the slide board shown in the Figures by polyethylene blowing a hollow body. By means of this process, articles can be made only that are one-walled, which in FIG. 4 corresponds to one single continuous peripheral line in cross-section. If it was intended to cover the grooves of the bracing webs that are open towards the step face board 1, a further working step would be necessary and thus a higher price and a higher weight of the slide board would be unavoidable.

It is important to provide the open grooves in the step face instead of the slide face 2 so that they cannot influence the slide properties of the slide face 2.

In FIG. 5 height lines are shown at the leading and trailing ends of the slide board, which symbolize the bent-up portions shown in FIG. 3.

Furthermore, the step faces 11 on the step face 1 can be seen in FIG. 5, said step faces consisting of dim (i.e. matt or lusterless) antiskid rubber linings, which are bonded into respective flat recesses on the step faces 1. For this purpose e.g. neoprene or cellular rubber may be used. The oval shown on the bottom in FIG. 5 serves for attaching the sign of a manufacturer, which can also be provided as an antiskid step face.

Finally, three dimensions are indicated by reference numerals d, h and b in FIG. 4. b designates the width of the step face 1 of the slide board, which in particular when used by a snow board for children can be chosen smaller than usual. It should preferably be adapted to the shoe size of the respective user. The manufacture of differently large slide boards for the different age groups of users is also possible.

d designates the "height difference" between the central slide structure 3 and the lateral guide structures 4, i.e. the amount by which the slide structure 3 projects more than the guide structures 4. The maximum slide board thickness h results from the entire height of the outer edge 7 with the lateral guide structure 4 and the additional "height" d of the slide structure 3.

The above-described details of the slide board according to the invention may be essential for the invention individually or in different combinations with one another.

What is claimed is:

1. A slide board comprising a blown plastic hollow body having inner bracing webs, the body being substantially hollow without foaming material, the slide board having a top side defining a step face and a bottom side defining a slide face with a centrally and downwardly projecting slide structure and elongated in a driving direction, the slide board further having at least one downwardly projecting guide structure on each side of the slide board when seen in the driving direction and elongated in the driving direction, the guide structures being convex with respect to the slide structure and extending less far downwardly than the slide structure, wherein the bracing webs are formed continuously over the length of the slide board by respective grooves in the top side defining the step face and are fused continuously over the length of the slide board to the bottom side defining the slide face.

2. A slide board according to claim 1, in which the slide structure has a ski-shape with a concavely, longitudinally extending recess and slide faces with straightly extending lateral rims.

3. A slide board according to claim 1, in which the slide structure is provided continuously over the length of the slide board.

4. A slide board according to claim 1, wherein the guide structure includes small rail projections.

5. A slide board according to claim 1, wherein on both sides of the slide structure an additional guide structure is provided.

6. A slide board according to claim 1, wherein lateral outer edges of the slide board are each evenly integrated with one guide structure.

7. A slide board according to claim 1 further comprising a braking projection which projects less far than the slide structure and extends transversely thereto at a rear of the slide board.

8. A slide board according to claim 1 having a step face which is anti-skid and provided without foot loops.

9. A slide board according to claim 1, wherein said hollow body is composed of polyethylene.

10. A slide board according to claim 1, wherein the slide structure has a ski-shape with a concavely, longitudinally extending recess and slide face with straightly extending lateral rims, said slide structure provided continuously over the length of the slide board.

11. A slide board according to claim 10, wherein said slide structure comprises rail projections arranged to be integrated with lateral outer edges of the slide board.

* * * * *